US008505456B2

(12) United States Patent
Haeselich

(10) Patent No.: US 8,505,456 B2
(45) Date of Patent: Aug. 13, 2013

(54) CARTRIDGE AMMUNITION HAVING A BURSTING DEVICE AS A CONNECTION BETWEEN PROJECTILE AND PROPULSION

(75) Inventor: Detlef Haeselich, Muessen (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 13/441,165

(22) Filed: Apr. 6, 2012

(65) Prior Publication Data

US 2012/0247360 A1 Oct. 4, 2012

Related U.S. Application Data

(63) Continuation of application No. PCT/EP2010/005663, filed on Sep. 15, 2010.

(30) Foreign Application Priority Data

Oct. 6, 2009 (DE) ..... 10 2009 048 365

(51) Int. Cl.
*F42B 5/02* (2006.01)

(52) U.S. Cl.
USPC ..... 102/443; 102/430; 102/482

(58) Field of Classification Search
USPC ..... 102/430, 443, 470, 439, 481, 441, 102/432, 446, 482, 487
See application file for complete search history.

(56) References Cited

U.S. PATENT DOCUMENTS

| | | | | | |
|---|---|---|---|---|---|
| 3,404,598 | A * | 10/1968 | Angelos | ..... | 89/1.14 |
| 3,967,552 | A * | 7/1976 | Settles et al. | ..... | 102/430 |
| 4,335,657 | A * | 6/1982 | Bains | ..... | 102/433 |
| 4,686,905 | A * | 8/1987 | Szabo | ..... | 102/444 |
| 4,762,068 | A * | 8/1988 | Lubbers | ..... | 102/439 |
| 4,782,758 | A * | 11/1988 | Washburn | ..... | 102/434 |
| 4,815,387 | A * | 3/1989 | Lubbers | ..... | 102/439 |
| 4,892,038 | A * | 1/1990 | Lubbers | ..... | 102/439 |
| 4,938,146 | A * | 7/1990 | Gunther et al. | ..... | 102/439 |
| 5,834,681 | A * | 11/1998 | DuBay | ..... | 102/430 |
| 5,936,189 | A | 8/1999 | Lubbers | | |
| 6,095,051 | A * | 8/2000 | Saxby | ..... | 102/444 |
| 6,253,682 | B1 * | 7/2001 | Saxby | ..... | 102/444 |
| 6,427,600 | B2 * | 8/2002 | Saxby | ..... | 102/444 |
| 7,107,909 | B2 | 9/2006 | Haeselich | | |
| 7,322,295 | B1 | 1/2008 | Haeselich | | |
| 7,793,591 | B1 * | 9/2010 | Van Stratum | ..... | 102/443 |
| 7,984,675 | B2 * | 7/2011 | O'Dwyer | ..... | 102/438 |
| 8,042,472 | B2 * | 10/2011 | Lubbers | ..... | 102/430 |
| 2008/0053330 | A1 * | 3/2008 | Haeselich | ..... | 102/513 |
| 2010/0288152 | A1 * | 11/2010 | Luebbers | ..... | 102/430 |
| 2012/0192751 | A1 * | 8/2012 | Lafortune | ..... | 102/439 |

FOREIGN PATENT DOCUMENTS

| | | | |
|---|---|---|---|
| DE | 195 27 621 | A1 | 1/1997 |
| DE | 197 38 937 | A1 | 3/1999 |
| DE | 10 2004 020 838 | B3 | 6/2005 |
| WO | WO 2005/098345 | A1 | 10/2005 |

* cited by examiner

*Primary Examiner* — Benjamin P Lee
(74) *Attorney, Agent, or Firm* — Muncy, Geissler, Olds & Lowe, PLLC

(57) ABSTRACT

A cartridge ammunition, in particular grenade ammunition, is provided that includes a projectile and a propellant charge case for accommodating the projectile and a propulsion, having a high pressure chamber and a low pressure champer, wherein the projectile and the propellant charge case are fastened to one another by way of a connection. The connection includes a membrane having at least one target braking point/opening point, which opens at a predetermined pressure in the high pressure chamber of the propulsion.

8 Claims, 2 Drawing Sheets

CARTRIDGE AMMUNITION HAVING A BURSTING DEVICE AS A CONNECTION BETWEEN PROJECTILE AND PROPULSION

This nonprovisional application is a continuation of International Application No. PCT/EP2010/005663, which was filed on Sep. 15, 2010, and which claims priority to German Patent Application No. DE 102009048365.9, which was filed in Germany on Oct. 6, 2009, and which are both herein incorporated by reference.

BACKGROUND OF THE INVENTION

1. Field of the Invention

The invention relates to a cartridge with a burst connection without overflow bores.

2. Description of the Background Art

From DE 195 27 621 A1, which corresponds to U.S. Pat. No. 5,936,189, a cartridge ammunition, in particular a grenade ammunition, is known that comprises a projectile and a cartridge case for accommodating the projectile, wherein the projectile comprises an active charge and a tracer at the rear, and the cartridge case has an ignition charge and a cartridge bounding the high pressure chamber and containing a propulsion charge. The cartridge comprises a low pressure chamber and a high pressure chamber, which is connected to the low pressure chamber by overflow openings. The projectile is in turn connected to the cartridge, which has a predetermined breakage point. Here, the tracer is accommodated in a tube projecting centrally away from the rear of the projectile, which, after breakage of the predetermined breakage point, is pulled out of the high pressure chamber while increasing its volume.

A further cartridge ammunition is disclosed in DE 197 38 937 A1. This also comprises overflow openings, via which the high pressure chamber is connected to the low pressure chamber.

With DE 10 2004 020 838 B3, which corresponds to U.S. Pat. No. 7,107,909 and to U.S. Pat. No. 7,322,295, a cartridge ammunition, in particular a training ammunition, is disclosed, in which expansion channels, which are filled with a fusible material, are provided between the propulsion chamber and the exterior of the cartridge case.

Although the above solutions have been proven in practice, they are also subject to the new requirements, such as increasing safety and optimal function.

SUMMARY OF THE INVENTION

It is therefore an object of the invention to provide a cartridge that will meet the aforementioned requirements.

In an embodiment, the invention is based on the idea, in order to take the requirements for increasing safety into account, to no longer introduce bores into the nozzle arrangement and, in continuation of the concept, to no longer use copper dishes.

For this purpose, in an embodiment, the invention provides that a projectile and its propulsion device are screwed together, wherein this screw connection comprises a membrane with a predetermined breakage point/opening point, which opens at a predetermined pressure in the high pressure chamber. Following the rupture of the connecting or burst membrane at the accurately set opening pressure, the projectile can move forward freely. There are no further connection points to be overcome, such as the case mouth constriction/projectile. Following the opening of the burst membrane, there is an annular throttle cross section, which regulates the controlled flow of propulsion charge powder gas from the high pressure chamber to the low pressure chamber below the projectile. The throttle pin in the throttle bore can be part of the projectile and, for example, a tracer.

The membrane can have a sprung damping effect on the projectile mass during rearward acceleration of the cartridge during the release process and provides relief at the edge of the case when withdrawing the case from the closure with pulling claws on the closure. In this way the extractor groove crack problem is counteracted.

In addition to the technical advantage, there is a significant material and cost saving as a result of the proposed design. By maintaining the basic design, it is also guaranteed that this ammunition can be fired from all standard weapons using the new propulsion device. The constant speed and the problem-free use of an optional tracer (modularity) are retained. In addition, the existing working systems can continue to be used during manufacture. Stamped copper disks, which act in the firing direction and can also cause erosion on the inner wall of the propulsion charge case, will now no longer be used.

A cartridge ammunition is thus proposed, in particular a grenade ammunition, having a projectile and a propulsion charge case for accommodating the projectile and a propulsion device. This includes a high pressure chamber and a low pressure chamber. The projectile and the propulsion charge case are connected to each other, wherein this connection comprises a membrane with at least one predetermined breakage point/opening point, which opens at a predetermined pressure in the high pressure chamber of the propulsion device. The connection is preferably a screw connection, bayonet connection or plug connection etc.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
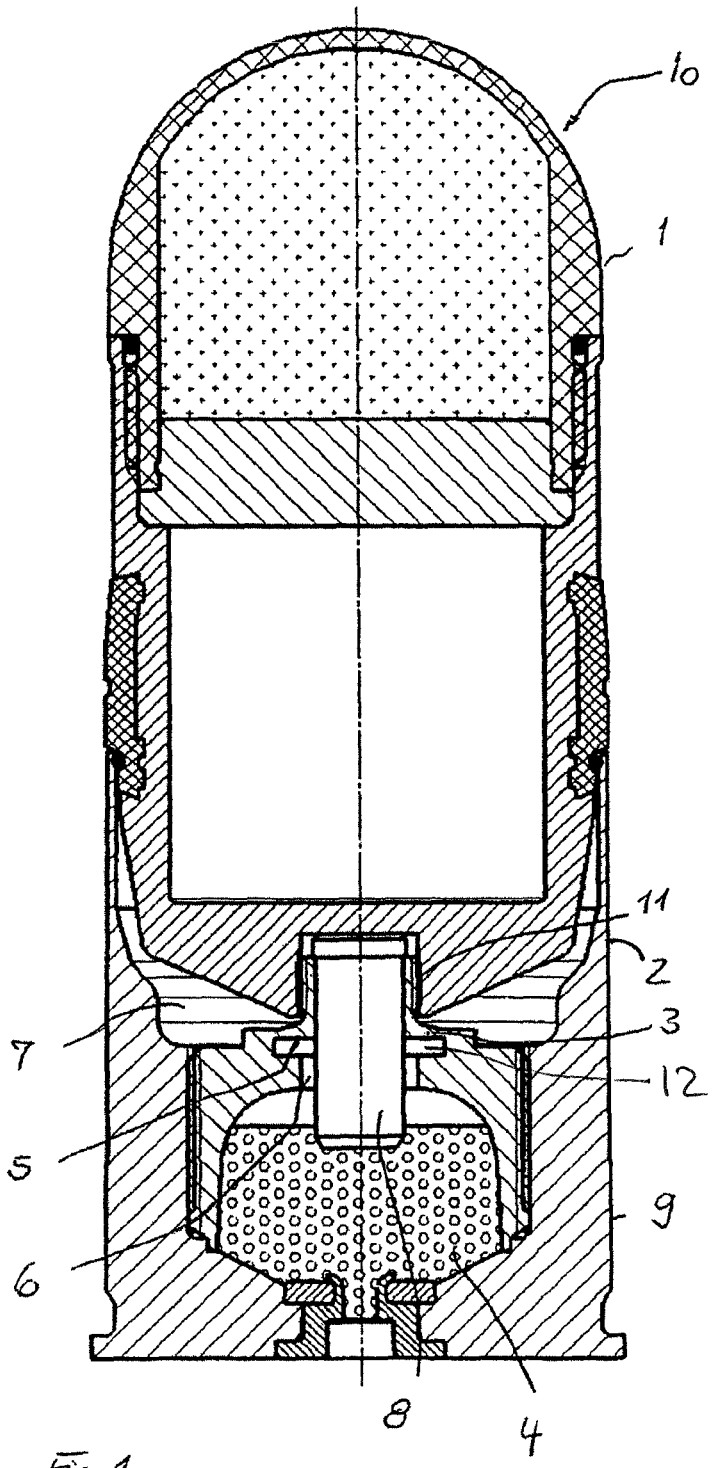
FIG. 1 is a cartridge ammunition in a sectional representation.

In FIG. 1, a cartridge 10 is represented in cross section with a projectile 1 and propulsion device 2 contained in a propulsion charge case 9. The two are connected together, preferably screwed using a screw connection 11, which comprises a membrane 5 with at least one predetermined breakage point/opening point 3. This opens at a predetermined pressure in the high pressure chamber 4 of the propulsion device 2. Furthermore, as shown, an annular hollow cavity 12 is provided adjacent the membrane 5, at a position that surrounds a throttle pin 8.

Figure 2:
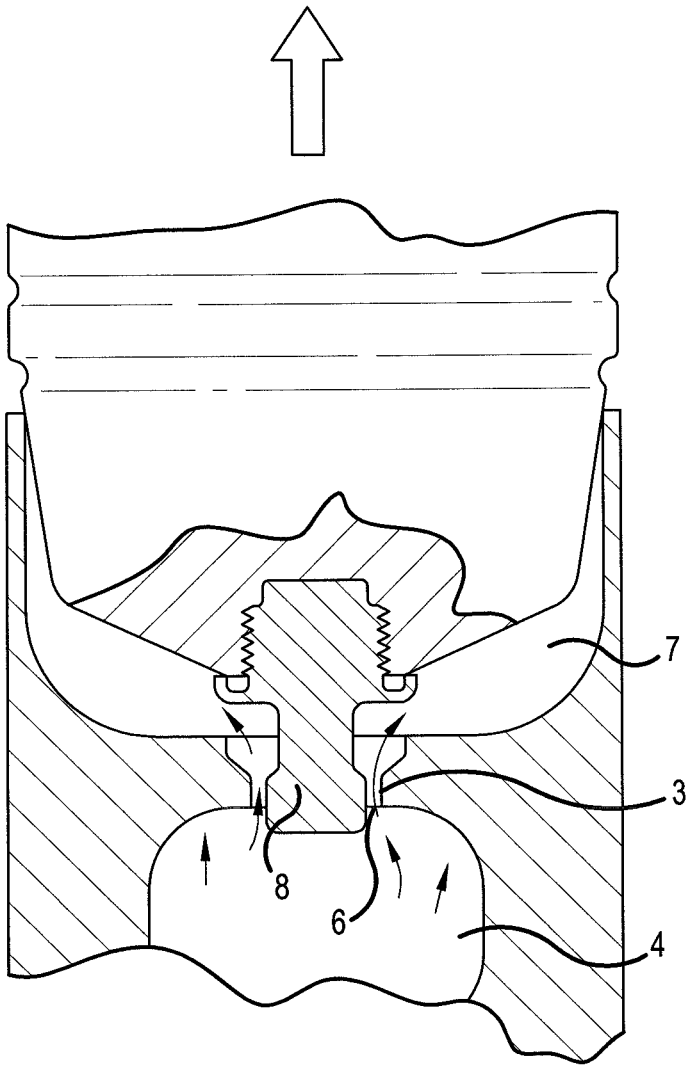
FIG. 2 is a sketch-like representation of a ruptured membrane between parts of the propulsion device of the ammunition from FIG. 1.

Following the rupturing of the membrane 5, the projectile 1 moves forward (FIG. 2). With the opening of the membrane 5, an annular throttle cross section 6 is preferably formed, through which a controlled flow of the propulsion charge powder gas from the high pressure chamber 4 into the low pressure chamber 7 takes place. A throttle pin 8 in the throttle bore is important for this control process, and it can be part of the projectile 1, but also a tracer (not shown in detail).

The high pressure can be maintained for longer, and therefore better regulated, as a result of the design of the throttle cross section 6, so that the propulsion charge gases flowing across at first flow rapidly out of the high pressure chamber 4, so as to prevent an unwanted high pressure peak. If the projectile 1 with the throttle pin 8 (preferably of conical shape) is moved further forwards and hence out of the throttle bore, the further pressure rise can be so regulated that a shallow gas pressure rise in the low pressure chamber 7 is achieved. As a result of this shallow—slow—pressure rise, the propulsion charge case 9 is also accelerated rearwards more slowly, so that the closure claws have to exert less force on the case edge when releasing the loaded cartridge 10.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A cartridge ammunition comprising:

a projectile;

a propulsion charge case for accommodating the projectile;

a propulsion device having a high pressure chamber and a low pressure chamber, and a throttle pin, wherein the projectile and the propulsion charge case are attached to each other by a connection portion that includes a membrane provided adjacent thereto, the connection portion and the membrane surrounding the throttle pin, and the membrane having at least one predetermined breakage point/opening point that opens at a predetermined pressure in the high pressure chamber of the propulsion device, and wherein an annular hollow cavity is provided adjacent to the membrane, at a position that is between the membrane and the high pressure chamber along an axial direction of the throttle pin, the annular hollow cavity is formed so as to surround the throttle pin.

2. The cartridge ammunition as claimed in claim 1, wherein, with the opening of the membrane, an annular throttle cross section is formed.

3. The cartridge ammunition as claimed in claim 2, wherein a controlled overflow of the propulsion charge powder gases from the high pressure chamber into the low pressure chamber is created with a setting of the throttle cross section.

4. The cartridge ammunition as claimed in claim 3, wherein the throttle pin is integrated into a throttle bore of the throttle cross section for a controlled regulation function.

5. The cartridge ammunition as claimed in claim 4, wherein the throttle pin is part of the projectile as well as a tracer.

6. The cartridge ammunition as claimed in claim 4, wherein the throttle pin has a conical shape.

7. The cartridge ammunition as claimed in claim 1, wherein the cartridge ammunition is a grenade ammunition.

8. The cartridge ammunition as claimed in claim 1, wherein the connection portion is one of a screw connection, a bayonet connection and a plug connection.

* * * * *